United States Patent [19]

Hunter et al.

[11] 4,095,434

[45] Jun. 20, 1978

[54] MINE EQUIPMENT

[75] Inventors: Rodney James Anthony Hunter, Etwall; Derek Plummer, Burton upon Trent, both of England

[73] Assignee: Coal Industry (Patents) Limited, London, England

[21] Appl. No.: 624,234

[22] Filed: Oct. 20, 1975

[30] Foreign Application Priority Data

Nov. 19, 1974 United Kingdom ..... 50041/74

[51] Int. Cl.[2] ..... E21D 13/04

[52] U.S. Cl. ..... 61/63; 61/45 R; 61/84

[58] Field of Search ..... 61/63, 84, 85, 45 R, 61/42, 45 C; 52/749; 299/31-33; 214/1 H

[56] References Cited

U.S. PATENT DOCUMENTS

| | | | |
|---|---|---|---|
| 2,757,515 | 8/1956 | Wilbur et al. | 61/85 |
| 3,377,105 | 4/1968 | Wallers | 61/85 X |
| 3,410,098 | 11/1968 | Winberg | 61/85 |
| 3,558,193 | 1/1971 | Howarth | 61/85 X |
| 3,561,223 | 2/1971 | Tabor | 61/42 |
| 3,678,694 | 7/1972 | Haspert | 61/84 |
| 3,885,397 | 5/1975 | Fujimori | 61/45 R |
| 3,905,645 | 9/1975 | Bland | 61/85 X |

FOREIGN PATENT DOCUMENTS

| | | | |
|---|---|---|---|
| 768,071 | 5/1934 | France | 61/84 |
| 350,982 | 2/1961 | Switzerland | 61/84 |

*Primary Examiner*—Dennis L. Taylor
*Attorney, Agent, or Firm*—James C. Wray

[57] ABSTRACT

An elongated frame provides a track over a mining machine for a carriage which is hauled along by an endless chain. The carriage carries assembled crown roof support sections to adjacent the newly exposed rock boundary.

26 Claims, 16 Drawing Figures

MINE EQUIPMENT

This invention relates to mine equipment and in particular to apparatus for conveying underground roadway roof support sections.

Typically underground roadways are extended by well known ripping or heading machines which cut rock or mineral in advance of the roadway forming rock or mineral boundaries constituting the floor, side walls and roof of the advanced roadway. These newly exposed boundaries have to be supported as quickly as possible to protect the operators from falling rock and to prevent collapse of the roadway. In order to provide rapid roof support it is common for the operators to manhandle disassembled roof support sections from supply vehicles adjacent to the rear of the machine to the front of the machine where the sections are assembled before being lifted up to the roadway roof. Such a time consuming operation requires the machine to be inoperative during the assembling and setting of the roof support sections. During this manhandling operators are exposed to danger and also a substantial amount of possible cutting time is lost and the rate of advance of the roadway is reduced.

An object of the present invention is to safeguard operators and improve the efficiency of providing rapid roof support in an underground roadway and to enable higher rates of roadway advance to be achieved.

According to the present invention apparatus for conveying a roadway roof support section along a portion of an underground roadway adjacent to a mining machine, comprises an elongated frame adapted to be supported such that in use the frame extends along the portion of the roadway adjacent to the mining machine, a carriage adapted to carry the support section and advanceable along the elongated frame, and means for urging the support section from the advanced carriage towards a roof supporting position.

Preferably, the elongated frame is adapted to be secured to the machine.

Advantageously, the elongated frame is pivotally supported on legs adapted to be pivotally secured to the machine.

Conveniently, the elongated frame is moved about the pivotal supports by hydraulic rams.

preferably, the elongated frame is movable to and fro with respect to the mining machine between an advanced position and a withdrawn or rear position.

Advantageously, the to and fro movement of the elongated frame is achieved by means of the pivotal support.

Alternatively, the to and fro movement of the elongated frame is achieved by providing means on the frame which slidably engage support mountings for the frame.

Preferably, the carriage is hauled along the elongated frame.

Advantageously, the carriage slides along a slideway provided by the elongated frame.

Alternatively, the carriage has wheels arranged to run along a track provided on the elongated frame.

Advantageously, at least a portion of the carriage is slidably mounted relative to the elongated frame in a direction transverse to the elongated frame.

Alternatively, the elongated frame may be slidably mounted relative to the leg supports in a direction transverse to the elongated frame.

Conveniently, the apparatus is used with a mine roadway roof support comprising a crown section and at least one leg section having a support formation for supporting the crown section, the crown section being constituted by at least one beam adapted to be secured along its length to a second beam constituting at least a part of an adjacent crown section such that in use the beam assembly presents an end formation which corresponds with the support formation of the leg component such that the end of each beam abuts the support formation.

Preferably, the crown section comprises at least two spaced parallel beams interconnected by struts.

Advantageously, the crown section comprises a sheet extending between the two parallel beams.

One object of the present invention is to provide apparatus for conveying underground roadway roof support sections along a portion of a mine roadway adjacent to a mining machine.

Another object of the present invention is to provide an improved underground mine roadway roof support.

By way of example only, several embodiments of the present invention will be described with reference to the accompanying drawings in which.

Figure 1:
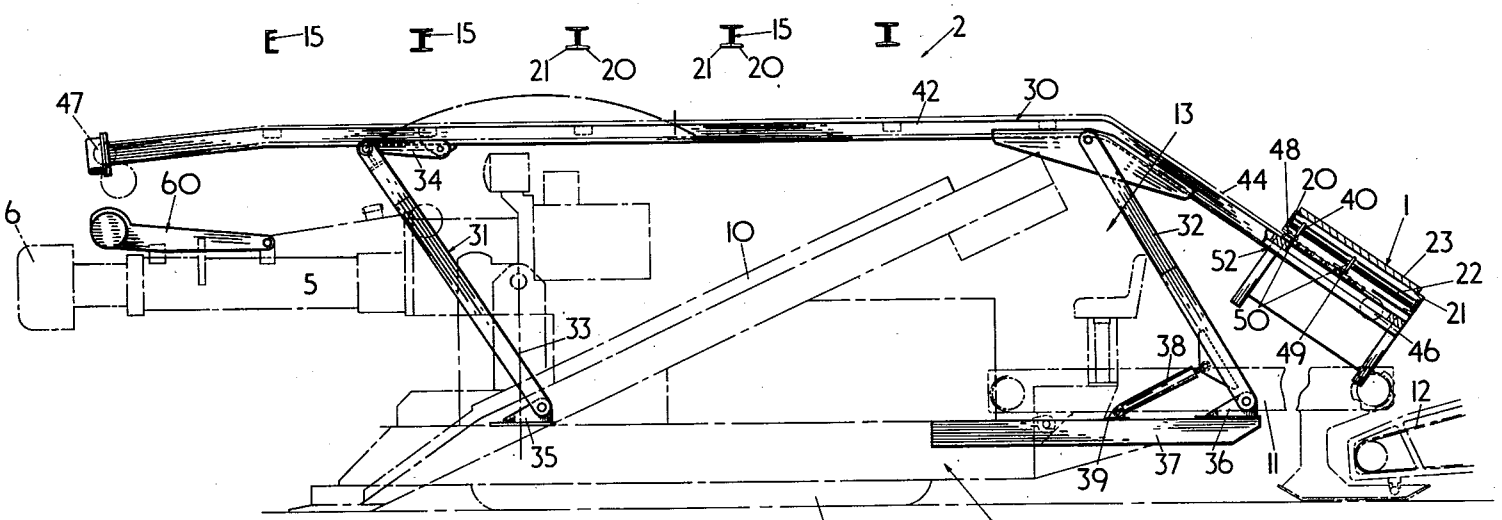
FIG. 1 is an incomplete side elevation partly in section, of a first embodiment of apparatus for conveying roof support sections along a portion of an underground mine roadway adjacent to a mining machine, the apparatus being shown in an operational position.

Referring now to FIGS. 1 to 7, these drawings show a first embodiment of apparatus for conveying roof support sections 1 along a portion of an underground mine roadway 2 adjacent to a mining machine 3 of a well known heading machine type including a floor mounted self-propelled base 4 and a boom 5 pivotally mounted on the base 4 and carrying a rotary cutter head 6 for excavating rock from a working face in advance of the roadway 2 to extend the roadway. The mining machine also includes conveyors 10 and 11 which feed cut rock to a roadway conveyor 12, and an operators seat and control panel 13.

Figure 2:
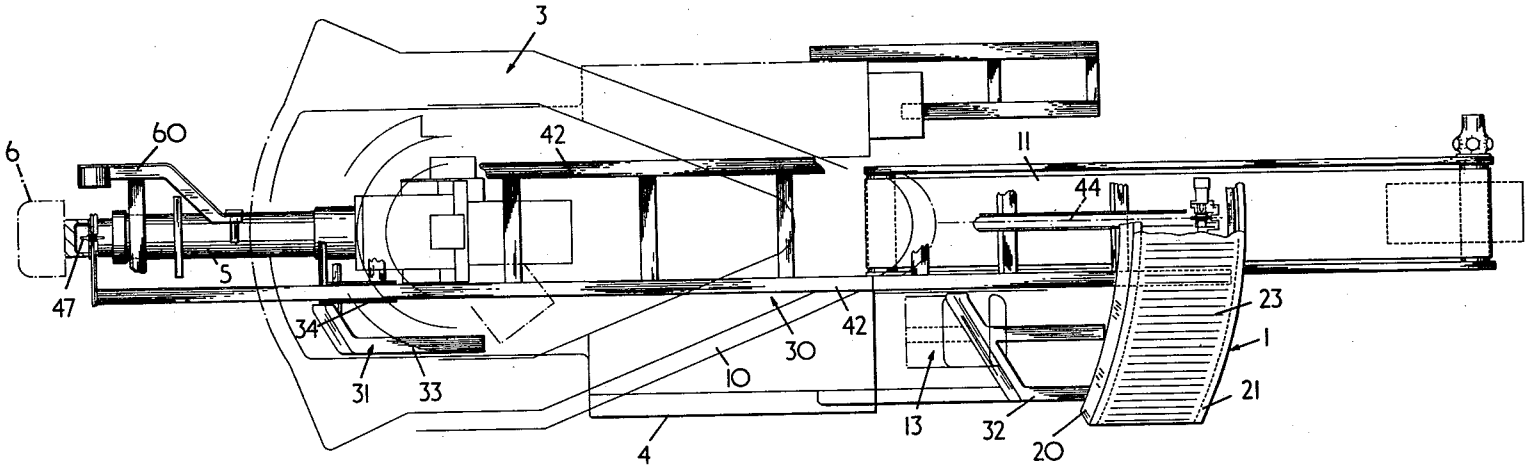
FIG. 2 is an incomplete plan, partly in section, of FIG. 1.
Figure 3:
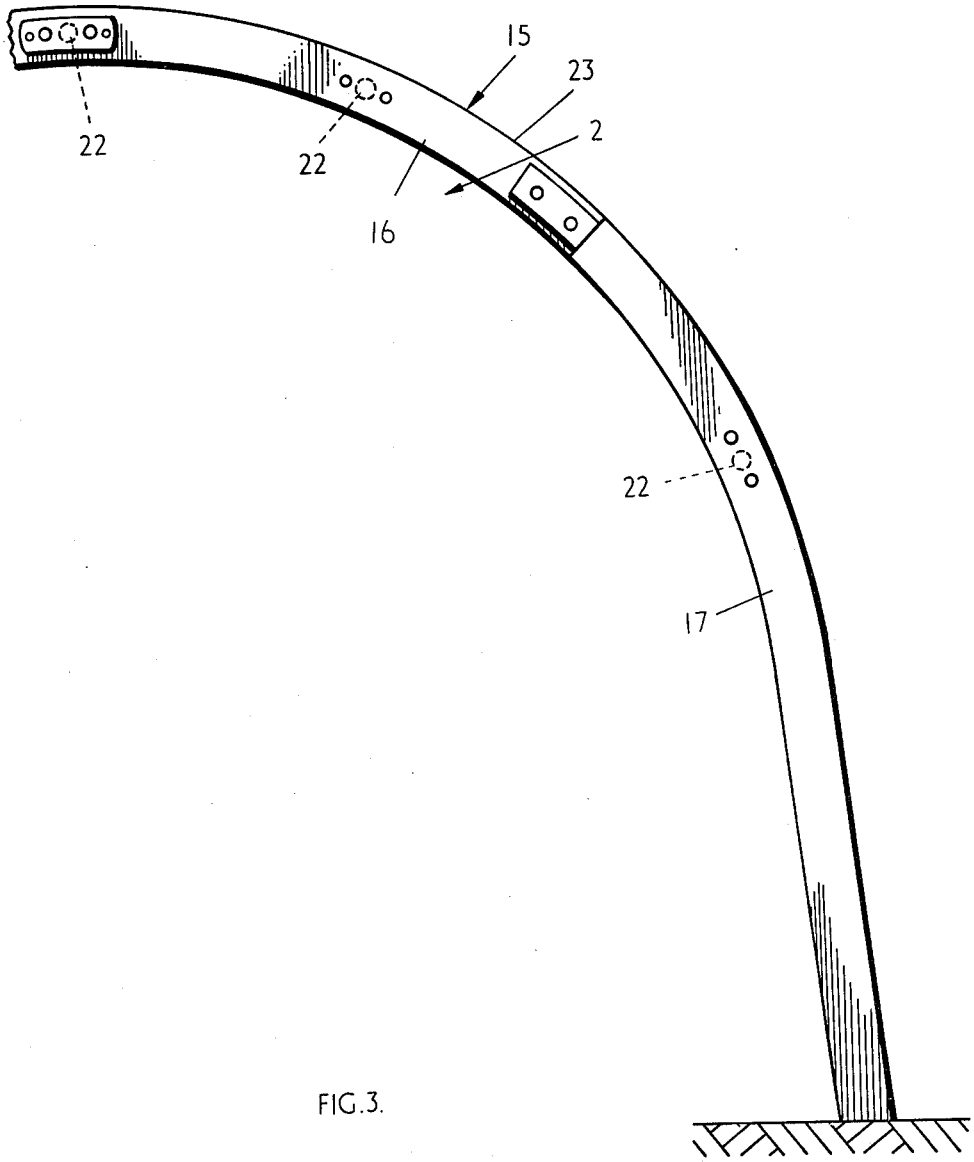
FIG. 3 is a front view of a portion of an underground mine roadway support.
Figure 4:
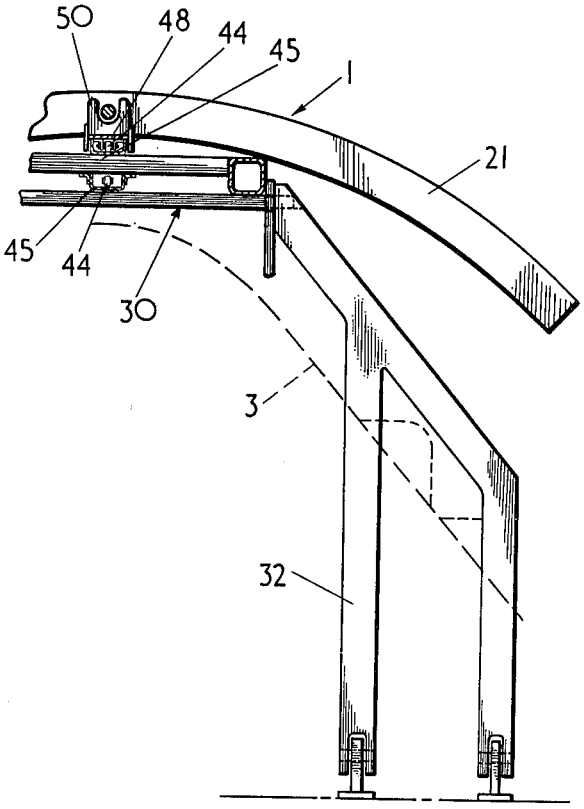
FIG. 4 is a rear view of a part of the apparatus of FIG. 1, a portion of the apparatus being shown in a different operational position.
Figure 5:
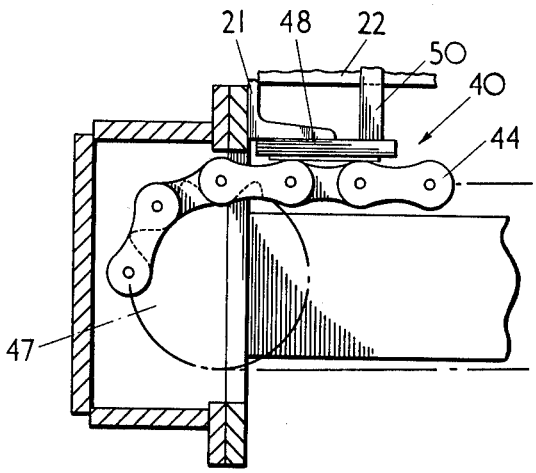
FIG. 5 is a scrap sectional side view of a part of the apparatus of FIG. 1, a portion of the apparatus being shown in a different operational position.
Figure 6:
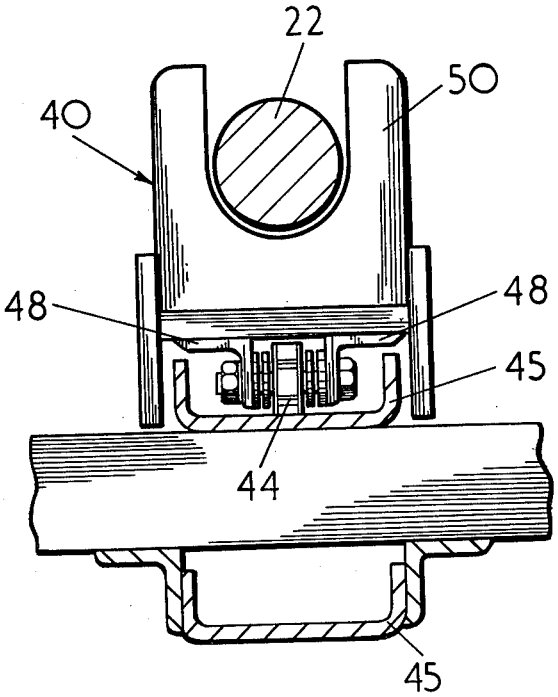
FIG. 6 is a scrap sectional view of the part of the apparatus of FIG. 5.
Figure 7:
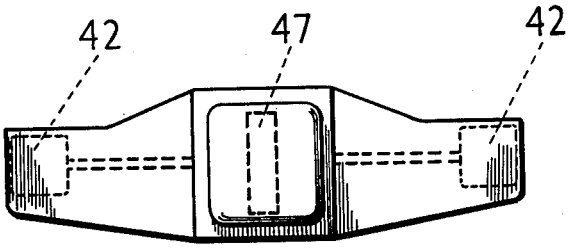
FIG. 7 is a front view of a detail of the apparatus of FIG. 1.
Figure 9:
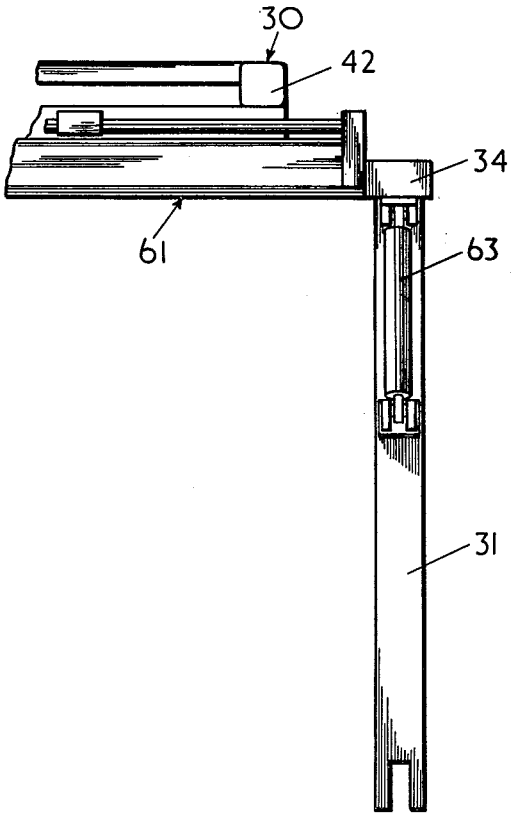
FIG. 9 is an incomplete rear view of the detail of FIG. 8.
Figure 8:
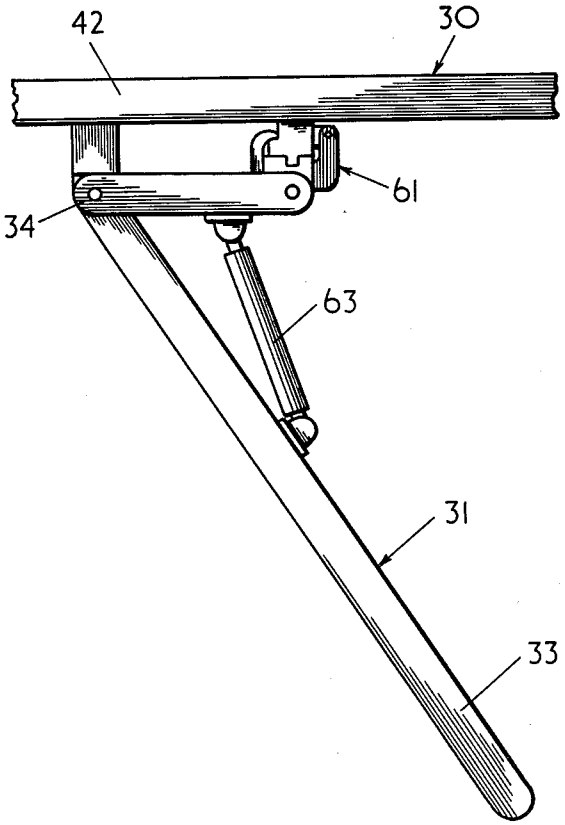
FIG. 8 is a side view of a detail of a second embodiment of apparatus constructed in accordance with the present invention.
Figure 10:
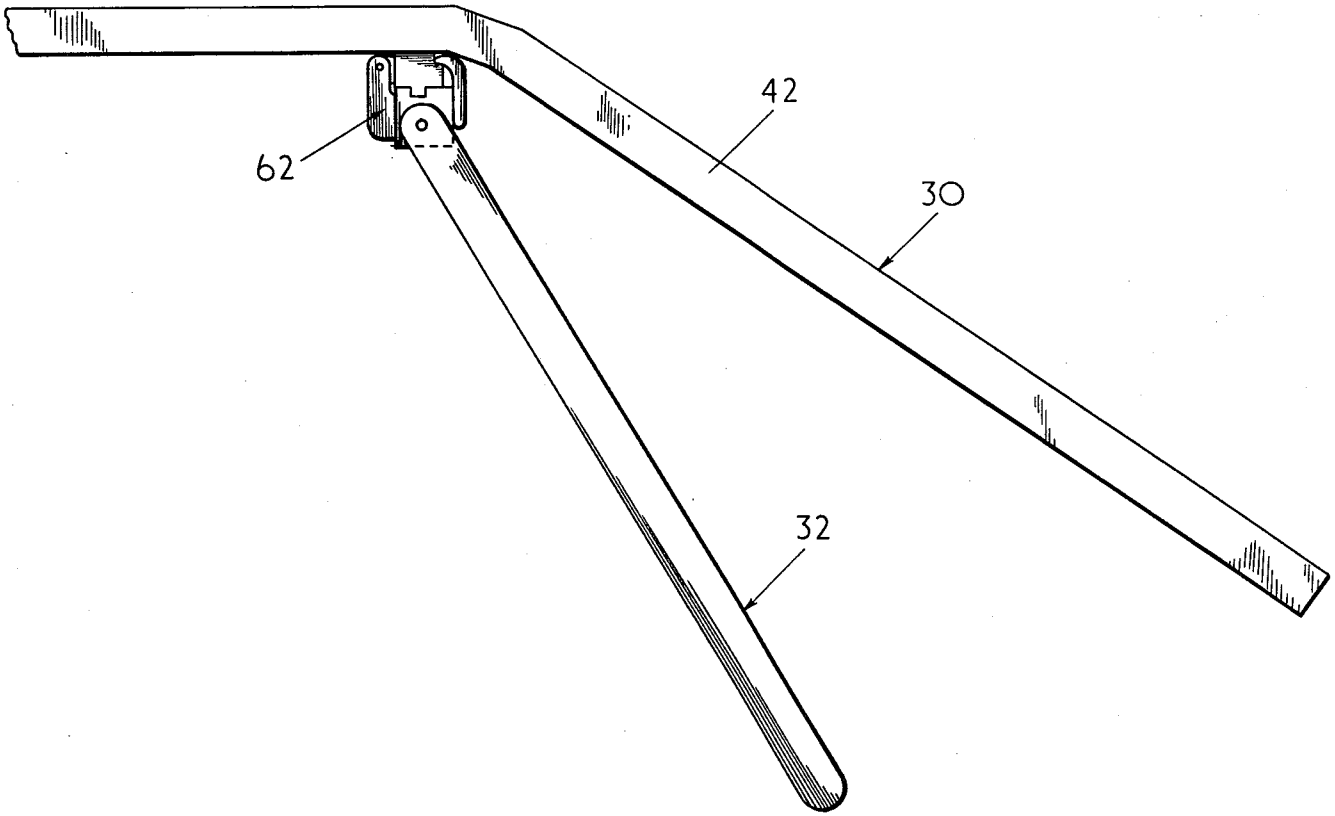
FIG. 10 is a side view of a further detail of the second embodiment of apparatus.
Figure 11:
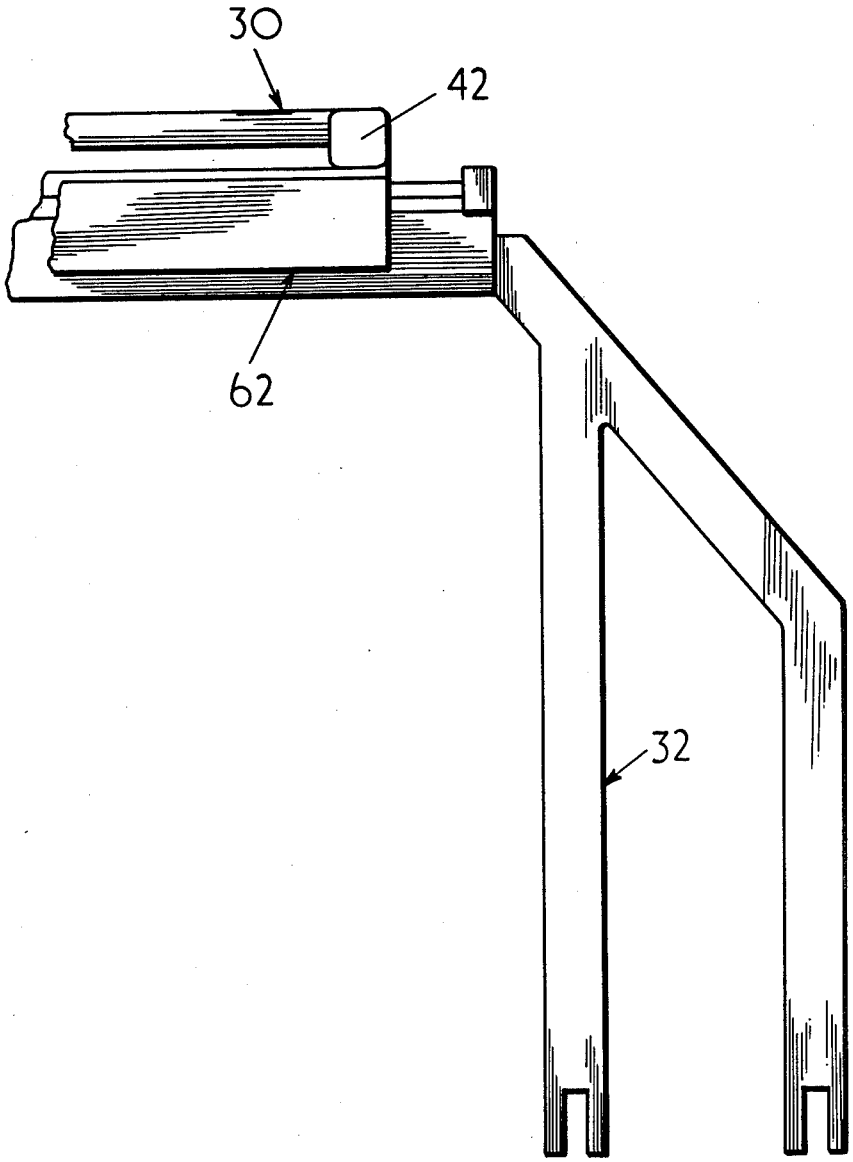
FIG. 11 is a rear view of the further detail of FIG. 10.
Figure 12:
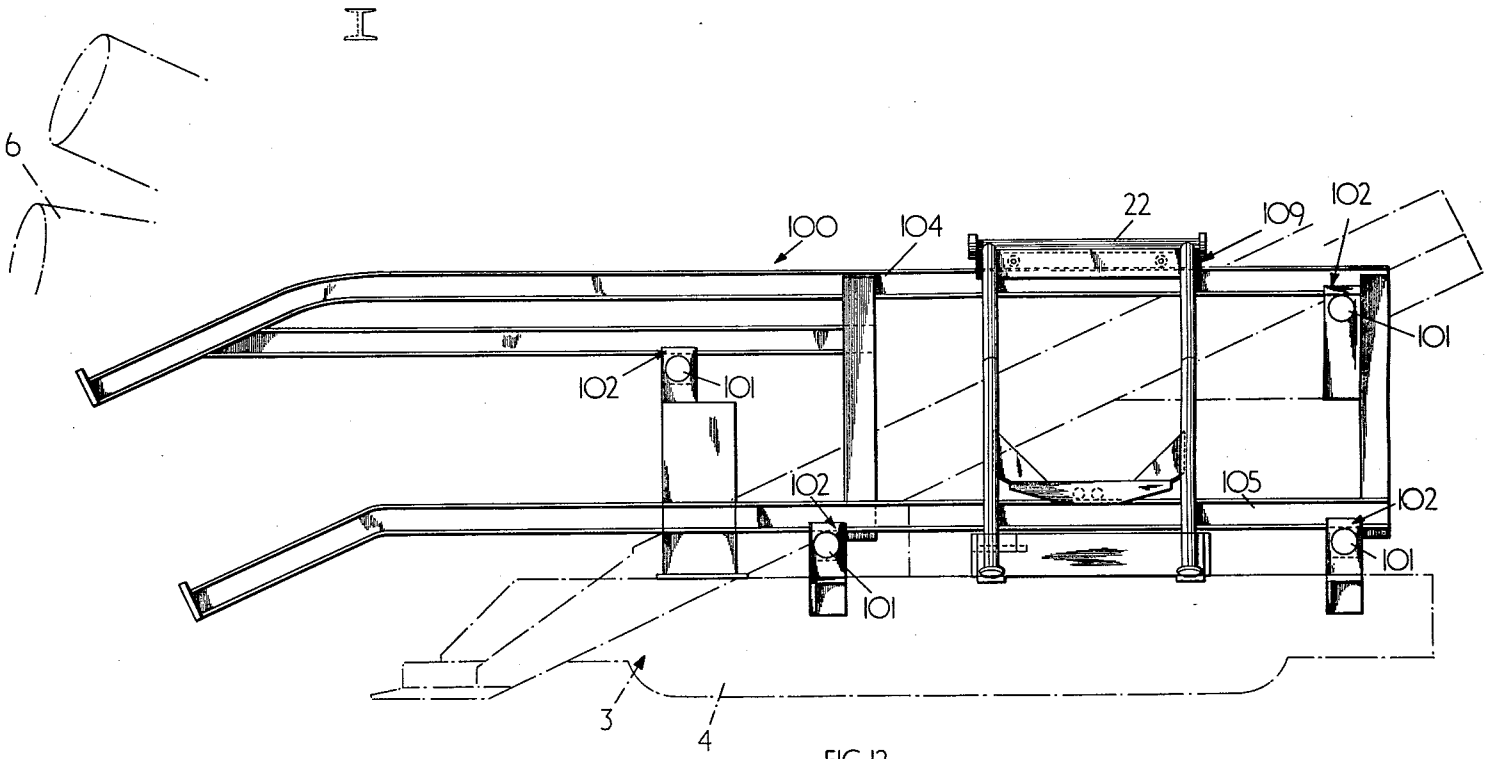
FIG. 12 is an incomplete side elevation of a third embodiment of apparatus constructed in accordance with the present invention and shown in an operational position.
Figure 13:
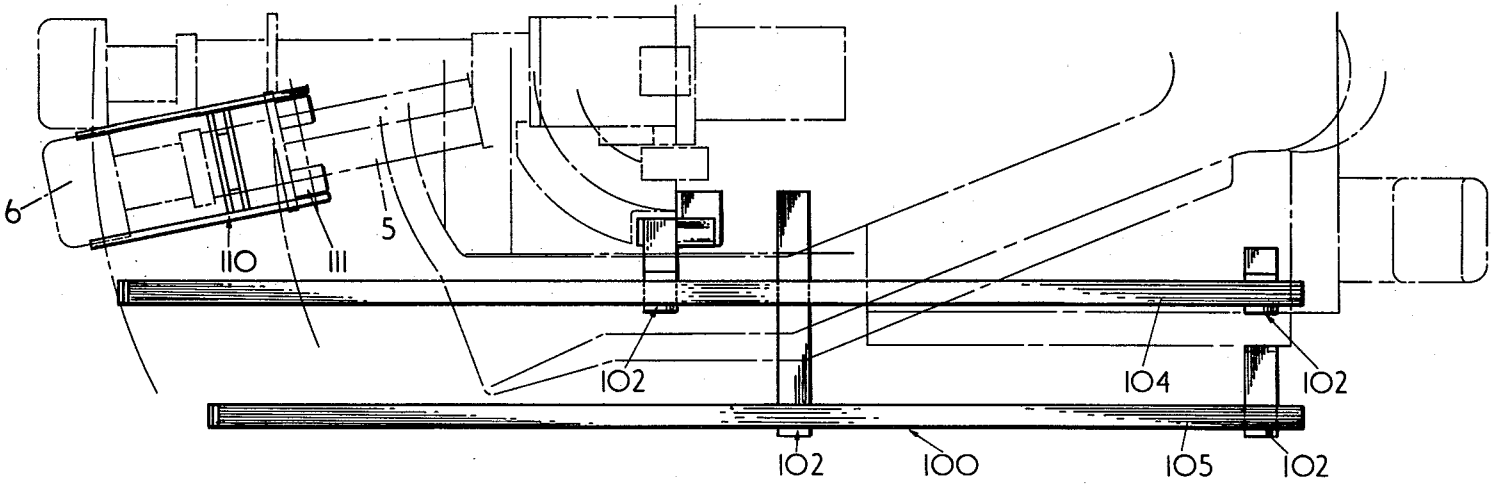
FIG. 13 is an incomplete plan of FIG. 12.

The roadway 2 is supported by a series of roof supports 15 (not shown in FIG. 2) extending along the roadway and each comprising a crown section 16 and two leg sections 17 (only one of which is shown, see FIG. 3). Each crown section comprises two parallel, opposed channel beams 20, 21 rigidly interconnected by struts 22 and by a sheet of corrugated or meshed material 23 extending between the beams 20, 21. Each of the beams 20, 21 is adapted to be secured along its length in back to back relationship to a beam 21, 20 constituting part of an adjacent crown section 15 such that the back to back beam assembly (20, 21) presents end formations which correspond with support formations provided on the leg sections, respectively. Each end of each of the beams 20, 21 in each back to back assembly, abuts the associated support formations. Thus, each beam 20, 21 of each crown section 15 is adequately and positively supported by an associated leg section 17.

In operation, when the cutter head 6 has excavated rock to advance the roadway sufficiently to allow a crown section 15 to be set the crown section is conveyed over the mining machine by means of apparatus to be described later in the specification to a position just below its set position. The crown section is then moved towards its set position in a manner described later where the ends of the beam 21 rest on the support formations provided by the ends of the associated leg sections 17. The beam 21 is then secured by for example bolts in back to back relationship with the parallel beam 20 of the previously set crown section. The forward beam 20 of the currently set crown section is then supported by support formation on two newly set leg sections. Thus cover is provided to protect operators when installing leg sections and rapid permanent roof suport is provided and cutting time lost by the mining machine for setting supports is relatively small.

The apparatus for conveying the roof support crown sections comprises an elongated frame 30 extending substantially the length of the mining machine and pivotally supported for to and fro movement relative to the mining machine by pairs of front and rear legs 31 and 32, respectively. The front legs 31 comprise two pivotally connected limbs 33, 34 and are pivotally mounted to brackets 35 mounted on the machine base while the rear legs 32 are pivotally mounted to brackets 36 secured to an outrigger platform 37 secured to the rear of the machine base. The elongated frame 30 together with the legs 31, 32 and the machine base form a parallelogram in side elevation as seen in FIG. 1, pivotal movement of the parallelogram being controlled by a pair of hydraulic rams 38 (only one of which is shown) pivotally connected between the rear legs 32 and a bracket 39 on the platform 37. Actuation of the rams 38 moves the elongated frame 30 to or fro relative to the machine between an advance position as shown in FIGS. 1 and 2 where the front portion of the frame is over the boom 5 to a rearward or withdrawn position where the front end of the frame is clear of the boom. This enables the machine to cut normally without interference from the frame.

A carriage 40 is movable along a track 42 provided along the elongated frame 30, the carriage being hauled to and fro along the track by a driven endless chain 44 which slidably engages in channels 45 and which passes around return sprockets 46 and 47. The carriage 40 is provided with dogs 48, 49 which fixedly engage the chain 44. Two location saddle brackets 50 are provided to engage the centre strut 22 to retain the crown section 1 in place on the carriage during transport.

In operation, a crown section is assembled on the rear portion 52 of the withdrawn elongated frame while the cutter head continues to cut rock to advance the roadway. As soon as sufficient rock has been excavated to allow the crown section to be set the boom is lowered to allow the elongated frame to be advanced towards the working rock face (as shown in FIGS. 1 and 2). The chain 44 is then started to haul the carriage 40 along the track until the crown section 1 lies beneath its desired set position. The boom 5 which is provided with a pivotally mounted support bracket 60 is then raised so that the support bracket 60 (moved to its forward position as shown in FIGS. 1 and 2) lifts the crown section from the track towards its set position where the ends of the beam 21 rest on the end support formations on the leg sections. The beam 21 is then secured in back to back relationship to the previously set beam 20 (as previously explained) and new leg sections 17 set to support the leading portion of the crown section. The elongated frame 30 is then withdrawn and the carriage returned to the rear end portion of the elongated frame. The support bracket 60 is then pivoted into its rearward position and the machine is able to recommence cutting while a further crown section is assembled on the withdrawn carriage.

Thus, it will be appreciated that the present invention provides apparatus for enabling previously assembled crown sections of roadway roof supports to be quickly conveyed to the desired set position and to be set with relatively small interference to the cutting procedure.

FIGS. 8, 9, 10 and 11 show details of a embodiment in which the elongated frame 30 is carried on slideways 61, 62 associated with the front and rear legs 31, 32 respectively. By actuation of rams (not shown) the position of the elongated frame 30 can be adjusted in a direction transverse to the longitudinal direction of the frame to aid the setting procedure. The advanced section is raised towards the desired set position by rams 63 (only one of which is shown) which are connected between two pivotally connected limbs 33 and 34 of the front legs 31 and which when actuated raise the front portion of the elongated frame together with the crown section. The front portion of the frame is able to move upwards relative to the machine base because the front legs 31 are made articulated comprising the two pivotally connected limbs 33 and 34. Once the crown section is raised towards the desired set position the position of the raised crown section can be manipulated by gradual actuation of the rams controlling transverse movement of the elongated frame and of the rams 63 controlling height adjustment of the elongated frame to permit the crown section to be steered to its desired position. The beam 21 is then secured to the beam 20 of the previously set crown section as described with reference to the first described embodiment. The remainder of the second embodiment of apparatus is as previously described with reference to FIGS. 1 to 7 of the drawings.

FIGS. 12 to 16 of the drawings show a third embodiment of apparatus for conveying roof support sections along a portion of underground mine roadway adjacent to a mining machine of the type as previously described with reference to FIGS. 1 to 7. The same reference numbers have been used for the same components of the mining machine as those previously used.

This embodiment of apparatus is particularly useful when the mining machine is in position adjacent to one side of the roadway as would be the case, for example, when the machine is cutting only a portion of the rock face, the remainder being previously cut by another machine working on a longwall face advancing ahead of the roadway.

When the machine is positioned adjacent to one side of the roadway it may not be convenient to convey roof support sections over the top of the machine along the machine's longitudinal axis as previously described because the axis of the conveyed crown section would be away from the longitudinal axis of the roadway. Thus, this embodiment of apparatus for conveying roof support sections is located adjacent to that side of the mining machine most remote from the roadway boundary.

Figure 15:
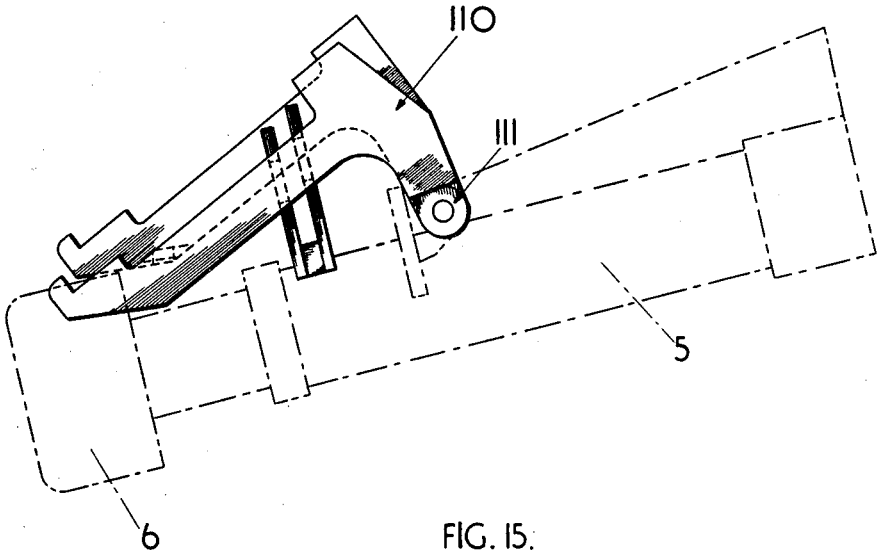
FIG. 15 is a side view of a front portion of the mining machine showing a detail of the apparatus of FIG. 12.
Figure 16:
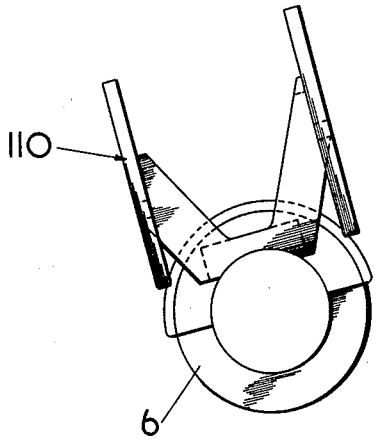
FIG. 16 is a front view of FIG. 15.

The apparatus comprises an elongated frame 100 slidably engaged on rollers 101 in a slideway 102 fixedly mounted on the machine base and including a track having upper and lower rails 104, 105 along which a wheel mounted carriage 109 is hauled to and fro by a driven haulage chain (not shown). The leading portion of the track 104, 105 dips to allow an advanced crown section on the carriage to take up a position where it can be picked up by a saddle bracket 110 (see FIGS. 15 and 16) pivotally mounted on the machine boom which moves the section into a desired set position. The saddle bracket 110 in FIG. 15 is shown in its forward position ready to pick up an advanced crown section. During cutting the saddle bracket 110 is moved about the pivot mounting 111 into a rearward position remote from the cutter head.

Figure 14:
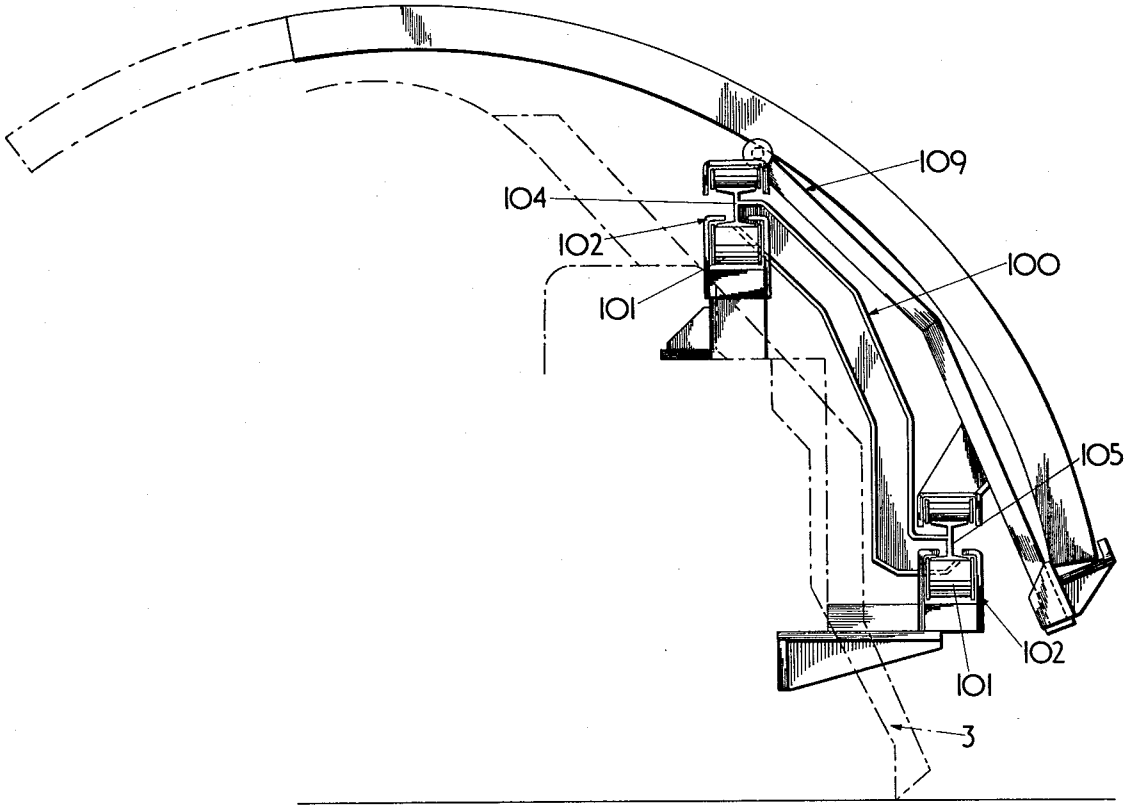
FIG. 14 is an incomplete front elevation of FIG. 12.

During cutting the elongated frame 100 is withdrawn to a rearward position and the carriage is hauled to its rearward position on the track. A crown section is then assembled on the carriage as indicated in FIG. 14 ready for when sufficient rock has been excavated to allow the crown section to be set. Cutting is then temporarily, briefly halted to allow the elongated frame to be advanced to the position shown in the drawings. Advancement of the elongated frame is by rams or chains (not shown). The loaded carriage is then advanced to the forward end of the track from where the crown section is raised by rams or chains (not shown) incorporated in the carriage 109 and is then picked up by the saddle bracket 110 which has been moved to its advanced position. The crown sections are then set in a similar manner to that previously described with reference to FIGS. 1 to 7.

In further embodiments of this invention the saddle bracket mounted on the machine boom can be slewed about an axis parallel to the boom axis. This enables the position of the crown section currently being set to be positioned accurately to help location of the securing device. Also this embodiment could be adapted to provide the means of conveying leg sections forward.

From the above description it can be seen that the present invention provides protection for operators securing arches and also permits assembled crown sections to be conveyed towards the working face and to be accurately aligned with the securing devices to speed up the setting procedure.

We claim:

1. Apparatus for conveying a roadway roof support section along a portion of an underground roadway adjacent to a mining machine, comprising an elongated movable frame, a plurality of legs pivotally connected to the frame and to the mining machine and hydraulic ram means connected between the mining machine and the legs whereby the elongated frame is moved about the pivotal connections by the hydraulic rams with respect to the mining machine such that in use the frame extends along the portion of the roadway adjacent to the mining machine, a carriage adapted to carry the support section and advanceable along the elongated frame, and means for urging the support section from the advanced carriage toward a roof supporting position.

2. Apparatus as claimed in claim 1, in which the elongated frame is pivotally supported on the legs which are pivotally secured to the machine.

3. Apparatus for conveying a roadway roof support section along a portion of an underground roadway adjacent to a mining machine, comprising an elongated frame, a plurality of legs connecting the frame to the mining machine such that in use the frame extends along the portion of the roadway adjacent to the mining machine, the elongated frame being pivotally supported on the legs which are pivotally secured to the machine, hydraulic rams connected between the legs and the mining machine, whereby the elongated frame is moved about pivotal supports by the hydraulic rams, a carriage adapted to carry the support section and advanceable along the elongated frame, and means for urging the support section from the advanced carriage toward a roof supporting position.

4. Apparatus as claimed in claim 3, further comprising means for moving the elongated frame to and fro with respect to the mining machine between an advanced position and a withdrawn or rear position.

5. Apparatus as claimed in claim 4, in which the frame, mining machine and legs form a parallelogram whereby to an fro movement of the elongated frame is achieved by means of the rams, legs and pivotal supports.

6. Apparatus as claimed in claim 4, including sliding support mountings connected between the legs and the frame in which the to and fro movement of the elongated frame is achieved by providing means on the frame which slidably engage support mountings on the legs for the frame.

7. Apparatus for conveying a roadway roof support section along a portion of an underground roadway adjacent to a mining machine, comprising an elongated frame adapted to be supported over the mining machine such that in use the frame extends along the portion of the roadway adjacent to the mining machine, a plurality of generally vertical legs pivotally connected to the frame and to the mining machine, hydraulic ram means connected between the legs and the mining machine whereby the elongated frame is moved about the pivotal connections by the hydraulic rams, a carriage adapted to carry the support section and advanceable along the elongated frame, means for urging the support section from the advanced carriage toward a roof supporting position, and a mechanism for hauling the carriage along the elongated frame.

8. Apparatus as claimed in claim 7, in which the carriage slides along a slideway provided by the elongated frame.

9. Apparatus as claimed in claim 7, in which the carriage has wheels arranged to run along a track provided on the elongated frame.

10. Apparatus for conveying a roadway roof support section along a portion of an underground roadway adjacent to a mining machine, comprising an elongated frame adapted to be supported over the mining machine such that in use the frame extends along the portion of the roadway adjacent to the mining machine, a plurality of generally vertical legs pivotally connected to the frame and to the mining machine, hydraulic ram means connected between the legs and the mining machine whereby the elongated frame is moved about the pivotal connections by the hydraulic rams, a carriage adapted to carry the support section and advanceable along the elongated frame, means for urging the support section from the advanced carriage toward a roof supporting position, and a mechanism for hauling the carriage along the elongated frame, at least a portion of the carriage being slidably mounted relative to the elongated frame in a direction transverse to the elongated frame.

11. Apparatus for conveying a roadway roof support section along a portion of an underground roadway adjacent to a mining machine, comprising an elongated frame adapted to be supported such that in use the frame extends along the portion of the roadway adjacent to the mining machine, leg supports connected to the elongated frame, a plurality of generally vertical legs pivotally connected to the frame and to the mining machine, hydraulic ram means connected between the legs and the mining machine whereby the elongated frame is moved about the pivotal connections by the hydraulic rams, a carriage adapted to carry the support section and advanceable along the elongated frame, means for urging the support section from the advanced carriage toward a roof supporting position, and a mechanism for hauling the carriage along the elongated frame, the elongated frame being slidably mounted relative to the leg supports in a direction transverse to the elongated frame.

12. The apparatus for conveying a roadway roof support section along a portion of an underground roadway adjacent to a mining machine, comprising an elongated frame, a plurality of legs connecting the frame to the mining machine such that in use the frame extends along the portion of the roadway adjacent to the mining machine, the elongated frame being pivotally supported on the legs which are pivotally secured to the machine, wherein the legs comprise forward legs and rearward legs, and wherein the forward legs comprise upper and lower sections which are pivotally connected to each other, and further comprising rams connected between the upper and lower sections for relatively moving the upper and lower sections, thereby vertically moving a forward portion of the frame, a carriage adapted to carry the support section and advanceable along the elongated frame, and means for urging the support section from the advanced carriage toward a roof supporting position.

13. The apparatus as claimed in claim 1 further comprising transversely movable support means for carrying the roof support section, and means slidably connecting the transverse support means to the carriage, whereby the roof support section may be adjusted transversely with respect to the frame and roadway.

14. The apparatus as claimed in claim 1, wherein the mining machine has a forward extending boom and a rotary cutter on the boom, and further comprising a support bracket mounted on the boom for engaging the roof support section, whereby the roof support section is received on the support bracket and is moved on the support bracket by moving the boom.

15. The apparatus for conveying a roadway roof support section along a portion of an underground roadway adjacent to a mining machine, comprising an elongated frame, a plurality of legs connecting the frame to the mining machine such that in use the frame extends along the portion of the roadway adjacent to the mining machine, the mining machine having a forward extending boom and a rotary cutter on the boom, and further comprising a support bracket mounted on the boom for engaging the roof support section, whereby the roof support section is received on the support bracket and is moved on the support bracket by moving the boom, wherein the boom further comprises a pivot means extending transversely to the boom and wherein the support bracket is connected to the pivot means on the boom, whereby the support bracket may be pivoted rearwardly to a stored position on the boom when not in use, a carriage adapted to carry the support section and advanceable along the elongated frame, and means for urging the support section from the advanced carriage toward a roof supporting position.

16. The apparatus as claimed in claim 1 further comprising a continuous chain mounted on sprockets adjacent opposite longitudinal ends of the frame, and channels connected to the frame between the sprockets for receiving the chain, and wherein the carriages comprise dogs for engaging the chain and upward extending brackets for engaging the roof support sections.

17. The apparatus as claimed in claim 16 wherein the roadway roof support sections comprise parallel beams extending transverse to the roadway and struts interconnecting the beams, and wherein the brackets comprise two saddle brackets for engaging center struts on the roof support sections.

18. Apparatus for conveying a roadway roof support section along a portion of an underground roadway adjacent to a mining machine, comprising an elongated frame extending along the portion of the mine roadway adjacent to the mining machine, a plurality of generally vertical legs pivotally connected to the frame and to the mining machine, hydraulic ram means connected between the legs and the mining machine whereby the elongated frame is moved about the pivotal connections by the hydraulic rams, a carriage adapted to carry the support section and advanceable along the elongated frame, and means for urging the support section from the advanced carriage toward a roof supporting position.

19. Apparatus as claimed in claim 18, in which the means for securing the elongated frame to the mining machine comprises leg support means pivotally attached to the elongated frame and pivotally attached to bracket means fixedly attachable to the mining machine.

20. Apparatus for conveying a roadway roof support section along a portion of an underground roadway adjacent to a mining machine, comprising an elongated frame extending along the portion of the mine roadway adjacent to the mining machine, leg support means pivotally attached to the elongated frame and pivotally attached to bracket means fixedly attachable to the mining machine for securing the elongated frame to the mining machine, hydraulic ram means attached to the leg support means and the bracket means for pivotally moving the leg support means about the bracket means, a carriage adapted to carry the support section and advanceable along the elongated frame, and means for urging the support section from the advanced carriage toward a roof supporting position.

21. Apparatus as claimed in claim 20, in which the elongated frame moves to and fro with respect to the mining maching between an advanced position and a withdrawn position by pivoting about the leg support means when the hydraulic ram means are actuated.

22. Apparatus as claimed in claim 21, comprising slide support means fixedly attached to the leg support means and slide means fixedly attached to the elongated frame, the slide support means and the slide means being arranged transversely of the elongated frame longitudinal axis such that the elongated frame can slide in a direction transverse to the elongated frame longitudinal axis.

23. Apparatus for conveying a roadway roof support section along a portion of an underground roadway adjacent to a mining machine, comprising an elongated frame extending along the portion of the mine roadway adjacent to the mining machine, a plurality of generally vertical legs pivotally connected to the frame and to the mining machine, hydraulic ram means connected between the legs and the mining machine whereby the elongated frame is moved about the pivotal connections by the hydraulic rams, a carriage adapted to carry the support section and advanceable along the elongated frame, means for urging the support section from the advanced carriage toward a roof supporting position, and mechanism for hauling the carriage along the elongated frame.

24. Apparatus as claimed in claim 23, in which the carriage slides along a slideway provided by the elongated frame.

25. Apparatus as claimed in claim 24, in which the carriage is arranged to run along a track provided on the elongated frame.

26. A mining machine comprising a floor mounted self propelled base, a boom pivotally mounted on the base, a rotary cutter head attached to the boom, an elongated frame, a plurality of generally vertical legs pivotally connected to the frame and to the base, hydraulic ram means connected between the legs and the base whereby the elongated frame is moved about the pivotal connections by the hydraulic rams, a carriage adaptable to carry mine roadway support sections and advanceable along the elongated frame, and means for urging the support section from the advanced carriage toward a roof supporting position.

* * * * *